US007994693B2

(12) United States Patent
Rosine

(10) Patent No.: US 7,994,693 B2
(45) Date of Patent: Aug. 9, 2011

(54) CURVED MCP CHANNELS

(75) Inventor: Steven David Rosine, Roanoke, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 675 days.

(21) Appl. No.: 11/941,302

(22) Filed: Nov. 16, 2007

(65) Prior Publication Data

US 2009/0127995 A1 May 21, 2009

(51) Int. Cl.
*H01J 43/00* (2006.01)

(52) U.S. Cl. ..... 313/105 CM; 313/103 CM

(58) Field of Classification Search ..... 313/103 CM, 313/105 CM; 250/214; 378/149; 210/797
See application file for complete search history.

(56) References Cited

U.S. PATENT DOCUMENTS

| | | | | |
|---|---|---|---|---|
| 3,838,996 | A | 10/1974 | Polaert et al. | |
| 3,883,335 | A | 5/1975 | Polaert | |
| 4,025,813 | A | 5/1977 | Eschard et al. | |
| 5,879,425 | A * | 3/1999 | Jensen | 65/393 |
| 6,215,232 | B1 * | 4/2001 | Johnson et al. | 313/103 CM |
| 6,259,088 | B1 * | 7/2001 | Antesberger | 250/214 VT |
| 2002/0116950 | A1 * | 8/2002 | Dunifon et al. | 65/106 |
| 2005/0122022 | A1 * | 6/2005 | Smith et al. | 313/103 CM |
| 2006/0153512 | A1 * | 7/2006 | Falkenstein et al. | 385/125 |
| 2007/0132351 | A1 * | 6/2007 | Downing et al. | 313/103 R |

FOREIGN PATENT DOCUMENTS

FR 2116913 6/1972

OTHER PUBLICATIONS

Joseph Wiza, "Microchannel Plate Detectors", Reprinted from Nuclear Instruments and Methods, vol. 162, 1979, pp. 587-601.
Search Report for EP 08168745.1-1232/2063451, Dec. 23, 2011.

* cited by examiner

*Primary Examiner* — Nimeshkumar D Patel
*Assistant Examiner* — Donald L Raleigh
(74) *Attorney, Agent, or Firm* — RatnerPrestia

(57) ABSTRACT

A microchannel plate (MCP) is formed from a boule. The MCP includes a plate having opposing end surfaces formed of acid resistant glass and acid etchable glass, and multiple channels extending longitudinally between the opposing end surfaces. The multiple channels are formed by circumferential walls of the acid resistant glass that surround the acid etchable glass. A respective circumferential wall forms a curved surface extending longitudinally between the opposing end surfaces. The curved surface is configured to reduce light from passing from one end surface to the other end surface. The acid resistant glass has a lower softening temperature than the acid etchable glass. As a result, the acid etchable glass may be subjected to a bending process, without reducing the diameter size of the microchannels that are formed after the bending process.

9 Claims, 7 Drawing Sheets

CURVED MCP CHANNELS

FIELD OF THE INVENTION

This invention relates, in general, to microchannel plates (MCPs) for use in image intensifier tubes, and in particular, to a microchannel plate having curved channels.

BACKGROUND OF THE INVENTION

Image intensifier tubes are used in night/low light vision applications to amplify ambient light into a useful image. A typical image intensifier tube is a vacuum device, roughly cylindrical in shape, and generally includes a body, photocathode and faceplate, microchannel plate (MCP), and output optic and phosphor screen. Incoming photons are focused on the glass faceplate by external optics, and strike the photocathode that is bonded to the inside surface of the faceplate. The photocathode converts the photons to electrons, which are accelerated toward the MCP by an electric field. The MCP has many microchannels, each of which functions as an independent electron amplifier, and roughly corresponds to a pixel of a CRT. The amplified electron stream, emanating from the MCP, excites the phosphor screen and a resulting visible image is passed through output optics to any additional external optics. The body holds these components in precise alignment, provides electrical connections, and also forms a vacuum envelope.

In general, fabrication of a microchannel plate starts with a fiber drawing process, as disclosed in U.S. Pat. No. 4,912,314, issued Mar. 27, 1990 to Ronald Sink, which is incorporated herein by reference in its entirety. For convenience, FIGS. 1-4, disclosed in U.S. Pat. No. 4,912,314 are included herein and discussed below.

In FIG. 1, there is shown a starting fiber 10 for the microchannel plate. Fiber 10 includes glass core 12 and glass cladding 14 surrounding the core. Core 12 is made of glass material that is etchable in an appropriate etching solution. Glass cladding 14 is made from glass material which has a softening temperature substantially the same as the glass core. The glass material of cladding 14 is different from that of core 12, however, in that it has a higher lead content, which renders the cladding non-etchable under the same conditions used for etching the core material. Thus, cladding 14 remains after the etching of the glass core. A suitable cladding glass is a lead-type glass, such as Corning Glass 8161.

The optical fibers are formed in the following manner: An etchable glass rod and a cladding tube coaxially surrounding the rod are suspended vertically in a draw machine which incorporates a zone furnace. The temperature of the furnace is elevated to the softening temperature of the glass. The rod and tube fuse together and are drawn into a single fiber 10. Fiber 10 is fed into a traction mechanism in which the speed is adjusted until the desired fiber diameter is achieved. Fiber 10 is then cut into shorter lengths of approximately 18 inches.

Several thousands of the cut lengths of single fiber 10 are then stacked into a mold and heated at a softening temperature of the glass to form hexagonal array 16, as shown in FIG. 2. The cut lengths of fiber 10 together form a hexagonal configuration. The hexagonal configuration provides a better stacking arrangement.

The hexagonal array, which is also known as a multi assembly or a bundle, includes several thousand single fibers 10, each having core 12 and cladding 14. Bundle 16 is suspended vertically in a draw machine and drawn to again decrease the fiber diameter, while still maintaining the hexagonal configuration of the individual fibers. Bundle 16 is then cut into shorter lengths of approximately 6 inches.

Several hundred of the cut bundles 16 are packed into a precision inner diameter bore glass tube 22, as shown in FIG. 3. The glass tube has a high lead content and is made of a glass material similar to glass cladding 14 and is, thus, non-etchable by the etching process used to etch glass core 12. The lead glass tube 22 eventually becomes a solid rim border of the microchannel plate.

In order to protect fibers 10 of each bundle 16, during processing to form the microchannel plate, a plurality of support structures are positioned in glass tube 22 to replace those bundles 16 which form the outer layer of the assembly. The support structures may take the form of hexagonal rods of any material having the necessary strength and the capability to fuse with the glass fibers. Each support structure may be a single optical glass fiber 24 having a hexagonal shape and a cross-sectional area approximately as large as that of one of the bundles 16. The single optical glass fiber, however, has a core and a cladding which are both non-etchable. The optical fibers 24, or support rods 24, are illustrated in FIG. 3, as being disposed at the periphery of assembly 30 and surrounding the plurality of bundles 16. The support rods are also known as filler fibers.

The support rods may be formed from one optical fiber or any number of fibers up to several hundred. The final geometric configuration and outside diameter of one support rod 24 is substantially the same as one bundle 16. The multiple fiber support rods may be formed in a manner similar to that of forming bundle 16.

The assembly formed when all support rods 24 have been placed around the ends of bundles 16 is called a boule, and is generally designated as 30 in FIGS. 3 and 5.

Boule 30 is fused together in a heating process to produce a solid boule of rim glass and fiber optics. The fused boule is then sliced, or diced, into thin cross-sectional plates. The planar end surfaces of the sliced fused boule are ground and polished.

In order to form the microchannels, cores 12 of optical fibers 10 are removed, by etching with dilute hydrochloric acid. After etching the thin plates, the high lead content glass claddings 14 remains to form microchannels 32, as illustrated in FIG. 4. Also, support rods 24 remain solid and provide a good transition from the solid rim of tube 22 to microchannels 32. After the plates are etched to remove the core rods, the channels in the plate are metalized and activated.

The current method of manufacturing an MCP also includes dicing the boule at an angle into thin wafers to produce a bias angle. The wafers are then etched, hydrogen fired to form a conduction layer, and metalized to provide electrical contact. After the boule is sliced into wafers, each wafer is handled individually. A typical size of the wafer is approximately 1 inch diameter.

The microchannels of an MCP each form a generally straight bore extending from input to output surfaces of the MCP. As shown schematically in FIG. 11, MCP 110 includes input surface 111 and output surface 112. The microchannels, designated as 113, are inclined at a bias angle with respect to the opposing input output surfaces. However, each microchannel forms a bore that is substantially centered about a straight axial line extending between the input and output surfaces.

Curved microchannels have been considered as a way of increasing gain of an MCP. Such curved channels have been very tricky and expensive to produce. No known MCP is produced with curved channels, although curved channel electron multipliers have been produced for testing purposes.

Two methods are known for making a curved channel MCP. Both methods are described below with respect to FIGS. 6 and 7.

The first method for making a curved channel MCP is shown in FIG. 6. As shown, MCP 63 is heated and placed between two horizontally sliding plates, top plate 61 and bottom plate 62. Each plate is notched to receive approximately one-half of the height of MCP 63. The top and bottom plates are brought together to completely nestle the MCP. Next, the top plate is slid horizontally with respect to the lower plate. This causes shearing of one end surface of the MCP with respect to the other end surface of the MCP, thereby providing curves to the microchannels. This method requires exceptional temperature control, very accurate movement of the shearing plates, and probably does not produce adequate uniformity for an imaging application.

The second method of making a curved MCP is shown in FIG. 7. As shown, MCP 73 is sandwiched between two heated plates 71 and 72. The two closed plates are spun in a counter-clockwise direction (for example). The spinning of the plates produces a centripetal force which pushes the center of the MCP outward. With the exterior surfaces of the MCP fixed by the notches in plates 71 and 72, it is believed that the result is curved channels in the MCP. Like the first method, this method requires accurate temperature control. This method also substitutes the difficulty of high-speed rotary motion for the problem of high accuracy linear motion. It will be understood, however, that the goal of each of these methods is higher gain, and not reduced light transmission.

SUMMARY OF THE INVENTION

To meet this and other needs, and in view of its purposes, the present invention provides a microchannel plate (MCP) formed from a boule. The MCP includes a plate having opposing end surfaces formed of acid resistant glass and acid etchable glass, and multiple channels extending longitudinally between the opposing end surfaces. The multiple channels are formed by circumferential walls of the acid resistant glass that surround the acid etchable glass. A respective circumferential wall forms a curved surface extending longitudinally between the opposing end surfaces. The curved surface is configured to reduce light from passing from one end surface to the other end surface. The acid resistant glass has a lower softening temperature than the acid etchable glass.

Another embodiment of the present invention includes a boule for forming multiple MCPs. The boule includes core rods formed of acid etchable glass, and cladding glass, surrounding the core rods, formed of acid resistant glass. The core rods and the cladding glass extend longitudinally between ends of the boule, and the core rods are smoothly curved between the ends of the boule. The core rods have a lower softening temperature than the cladding glass. The softening temperature of the core rods is at least 25 degree Centigrade lower than the softening temperature of the cladding glass. As an example, the softening temperature of the core rods is approximately 550 degrees Centigrade and the softening temperature of the cladding glass is approximately 580 degrees Centigrade. The core rods are substantially parallel to each other between the ends of the boule. A core rod forms a portion of a circle intersecting a chord, and the chord is approximately 8 inches in length and the furthest distance from the chord to the circle is approximately 0.4 inches.

Yet another embodiment of the present invention is a mold for bending a boule for making multiple MCPs. The mode includes a structure having a longitudinal direction and a transverse direction, and a notch formed in the structure, extending in the longitudinal direction between ends of the structure. The notch forms a U-shape, oriented in the transverse direction. The U-shape includes a portion of a first circle configured to receive and cradle a boule. The notch forms a portion of a second circle, oriented in the longitudinal direction, configured to impart a bend in the boule having a curved surface similar to the second circle. The structure is configured to receive the boule in a heated state having a first temperature effective in softening cladding glass in the boule, and having a temperature lower than a second temperature effective in softening core rods in the boule.

Still another embodiment of the present invention is a method for curving a boule having core rods and cladding glass surrounding the core rods. The method includes the steps of: heating the boule to a first temperature, wherein the first temperature is effective in softening the cladding glass; and bending the boule and, in turn, bending the core rods. The method also includes the steps of: placing the boule on a mold having a curved surface; and bending the boule after heating to the first temperature, so that the boule conforms to the curved surface. Another step includes dicing the boule to obtain multiple MCPs.

It is understood that the foregoing general description and the following detailed description are exemplary, but are not restrictive, of the invention.

BRIEF DESCRIPTION OF THE FIGURES

The invention may be understood from the following detailed description when read in connection with the following figures.

DETAILED DESCRIPTION OF THE INVENTION

Figure 8:
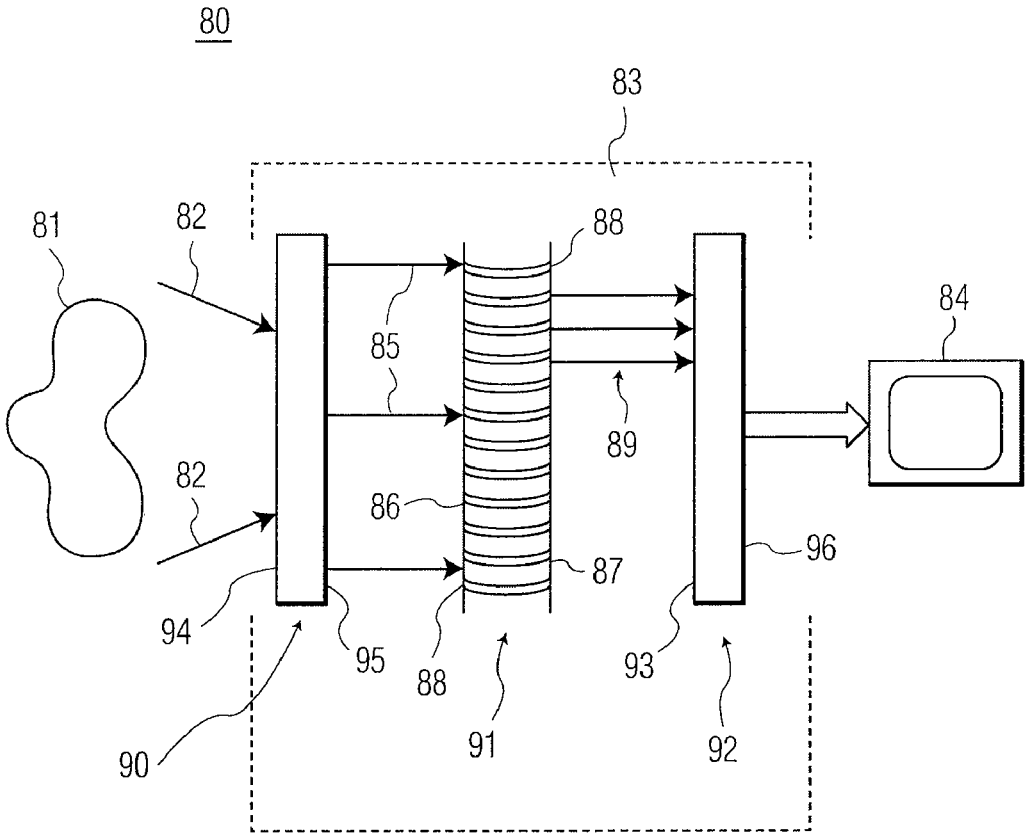
FIG. 8 is a functional block diagram of an image intensifier system, in accordance with an embodiment of the present invention.

An image intensifier includes an MCP disposed between a photocathode and an image sensing device. For example, as schematically shown in FIG. 8, image intensifier tube 80 includes MCP 91 disposed in vacuum housing 83 between photocathode 90 and image sensing device 92.

As shown, light energy 82 reflected from object 81 impinges upon photocathode 90. Photocathode 90 receives the incident energy on input surface 94 and outputs the energy, as emitted electrons, on output surface 95. The output electrons, designated as 85, from photocathode 90, are provided as an input to an electron gain device, such as MCP 91. The MCP includes input surface 86 and output surface 87. As electrons bombard input surface 86, secondary electrons are generated within microchannels 88 of MCP 91. The MCP generates several hundred electrons for each electron entering input surface 86.

Although not shown, it will be understood that MCP 91 is subjected to a difference in voltage potential between input surface 86 and output surface 87, typically over a thousand volts. This potential difference enables electron multiplication. Electrons 89, outputted from MCP 91, impinge upon solid state electron sensing device 92. Electron sensing device 92 may be a CMOS imager, for example, and includes input surface 93 and output surface 96, as shown in FIG. 8.

In general, electron sensing device 92 includes a phosphor screen on input surface 93. The output signals from electron sensing device 92 may be provided to image display 84 by way of a bus, or may be stored in a memory (not shown).

For reasons explained below, in an embodiment of the invention, MCP 91 includes curved microchannels 88.

Conventional microchannels of an MCP each form a generally straight bore extending from its input surface to its output surface. As shown schematically in FIG. 11, MCP 110 includes input surface 111 and output surface 112. The microchannels, designated as 113, are inclined at a bias angle with respect to the opposing input and output surfaces. Furthermore, each microchannel forms a bore that is substantially centered about a straight axial line extending between input and output surfaces 111 and 112.

Figure 11:
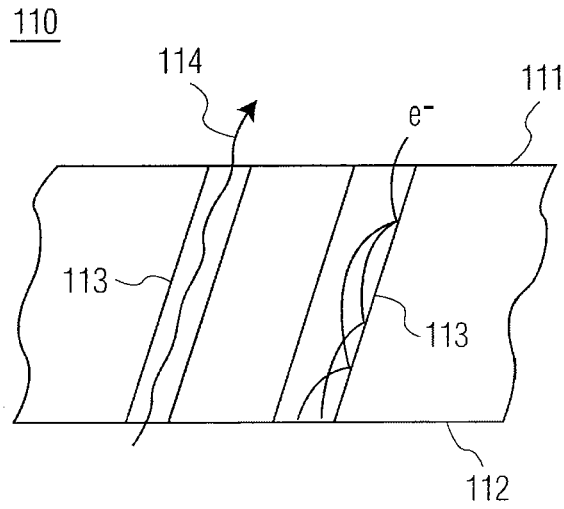
FIG. 11 is a pictorial of an MCP having straight bores.

The inventor has discovered that as a result of the straight microchannels, light 114 shown in FIG. 11 is reflected from or generated by a phosphor screen (not shown), re-enters microchannels 113, and exits the microchannels. Because light 114 propagates as photons from surface 112 to the other surface 111 without reflecting off the channel walls, light 114 is substantially unattenuated at the output surface of microchannels 112.

The photons, after exiting surface 111, impinge upon a photocathode (not shown) and are converted into electrons that emanate from the photocathode surface. These electrons are again amplified by the MCP. The phosphor screen converts the amplified electrons from the MCP into light. The phosphor screen is covered with an aluminum reflector layer, but this tends to have a multitude of small holes, and bleeds a small amount of light back towards the MCP. The MCP permits a small amount of light to pass through, and thus some screen light is able to re-activate the photocathode. This represents spatially-disconnected noise, and degrades the tube image.

Due to the intricacies of the screen process, the aluminum reflector layer is difficult to produce without holes. Additionally, there are known tradeoffs to the aluminum reflector thickness and its method of deposition, so reducing light leakage through changes in the screen process is likely to degrade phosphor efficiency, MTF and/or SNR.

Figure 12:
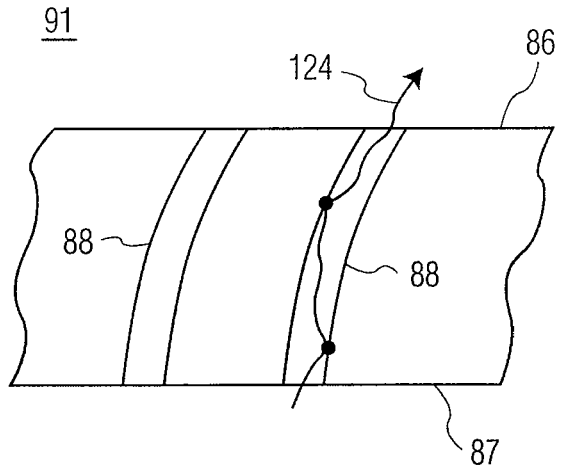
FIG. 12 is a pictorial of an MCP having curved bores, in accordance with an embodiment of the present invention.

In order to reduce light transmission through MCP 91, the inventor has discovered that curved microchannels, as shown in FIGS. 8 and 12, reduce the light transmission. Because light 124 (FIG. 12) propagates from surface 87 to surface 86 by reflecting off the walls of microchannels 88, light 124 is attenuated at surface 86. The light must make multiple reflections off the channel walls, thereby losing intensity after each reflection. Although light 124 may be re-activated by photocathode 90 into electrons 85 (FIG. 8) and may again be amplified by MCP 91, the resulting re-activated electrons are substantially reduced. Thus, curved microchannels 88 are effective in reducing re-activated electrons and in reducing spatially-disconnected noise.

Figure 5:
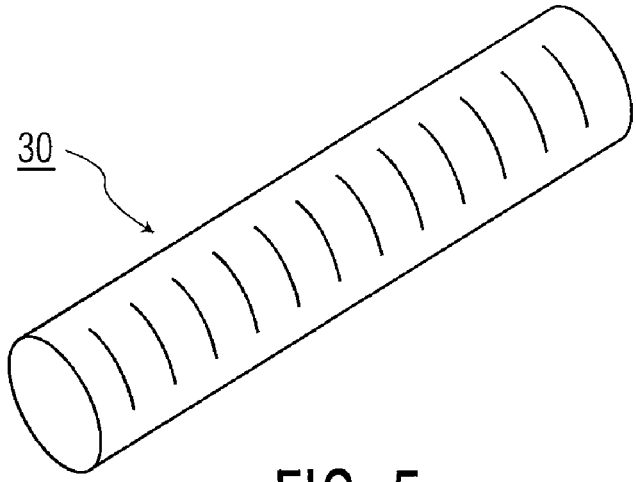
FIG. 5 PRIOR ART
FIG. 5 is a perspective view of a boule.
Figure 6:
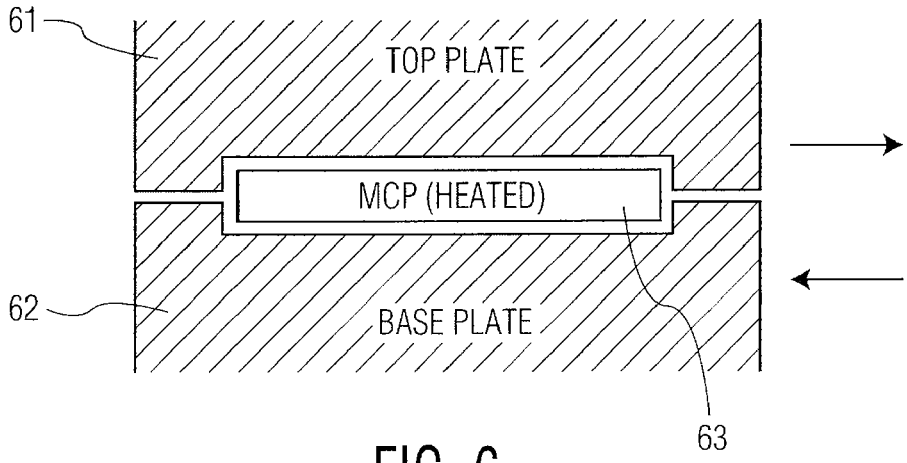
FIG. 6 PRIOR ART
FIG. 6 is a cross-sectional view of an MCP sandwiched between two plates, used for forming a shearing force to bend the channels of the MCP.
Figure 7:
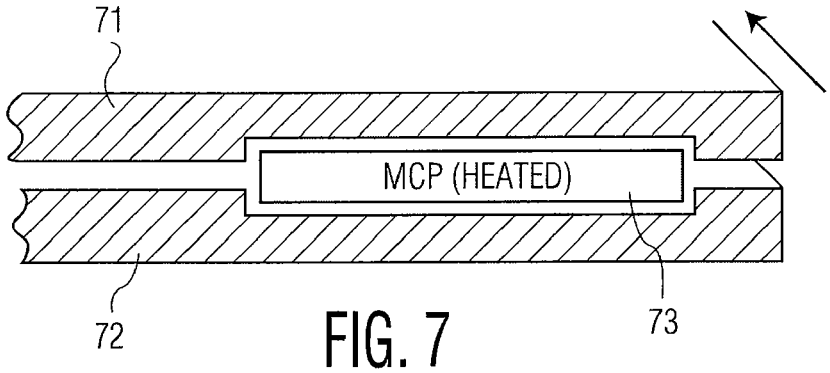
FIG. 7 PRIOR ART
FIG. 7 is another cross-sectional view of an MCP sandwiched between two plates, used for forming a centripetal force to bend the channels of the MCP.

The inventor considered different approaches to curving the channels of an MCP. One possible approach is heating and bending a boule, such as heating and bending boule 30 (FIG. 5). Simply heating and bending a boule, however, may not be desirable. The fibers disposed adjacent to the outer circumferential edge of the boule may be more stretched than the fibers disposed adjacent to the inner portion of the boule. If the outer edge fibers stretch more than the inner portion of fibers, the outer edge channels would likely be reduced in diameter. Since channel gain of an MCP is a function of channel aspect ratio, for a fixed MCP thickness, the stretched channels would cause shading in an image tube.

Figure 1:
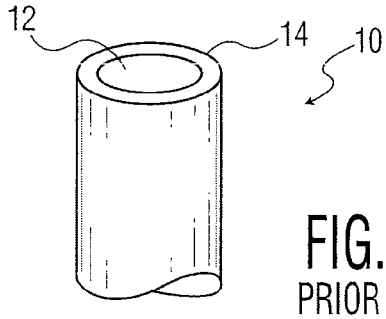
FIG. 1 PRIOR ART
FIG. 1 is a partial view of a fiber used in fabricating microchannel plates.
Figure 2:
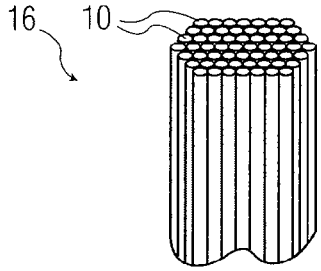
FIG. 2 PRIOR ART
FIG. 2 is a partial view of a bundle of fibers shown in FIG. 1 for use in fabricating microchannel plates.
Figure 3:
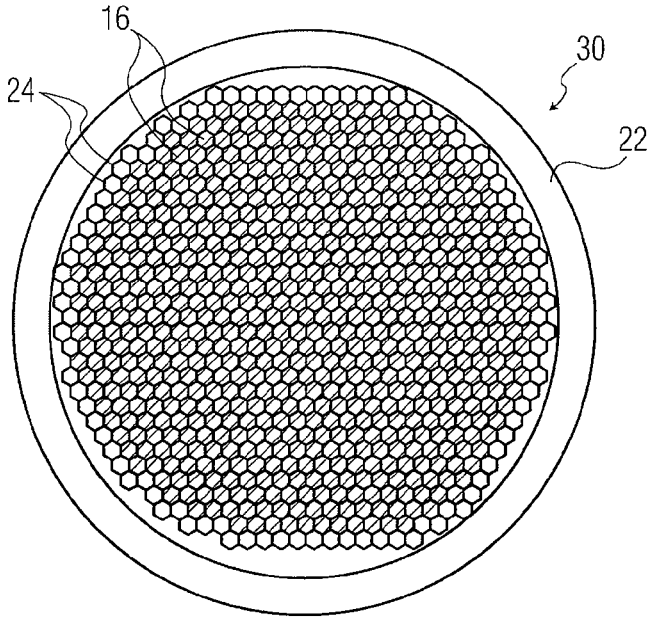
FIG. 3 PRIOR ART
FIG. 3 is a cross-sectional view of a packed boule.
Figure 4:
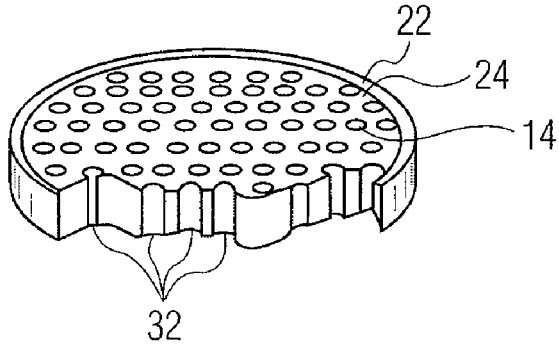
FIG. 4 PRIOR ART
FIG. 4 is a partial cut-away view of a microchannel plate.

The inventor discovered that a preferred approach to forming curved channels in an MCP is to bend a boule that is fabricated from two types of glass. In addition, one type of glass should have a higher forming temperature than the second type of glass. For example, the core rod (core 12 in FIG. 1) should have a higher forming temperature than the clad glass (cladding 14 in FIG. 1). For example, the softening temperature for the core rod may be approximately 580° C. and the softening temperature for the clad glass may be approximately 550° C.

The inventor discovered that the above 30° C. difference in the forming temperature is adequate to induce a curve in the boule and maintain the fibers in a rigid state without stretching the edge fibers. Thus, bending of boule 30 may be accomplished by heating the boule to the softening temperature of the clad glass and then bending the boule. Because the clad glass softens and shears, the boule is bent. The core rod, however, has a higher forming temperature and remains rigid at the lower softening temperature of the clad glass. As a result, the core rod resists stretching.

Figure 10A:
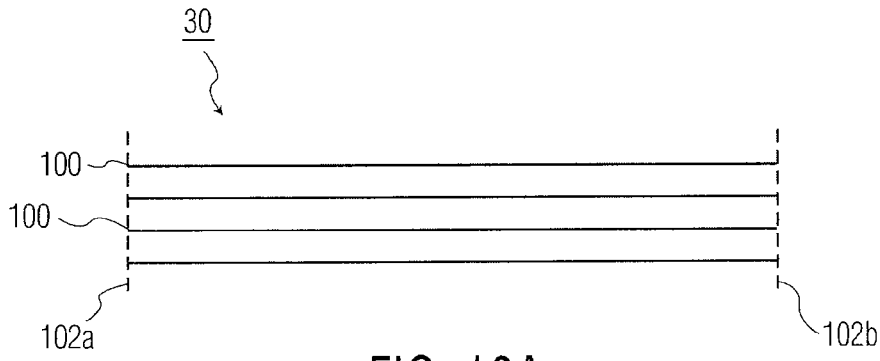
FIG. 10A is a partial cross-sectional view of a boule, before the microchannel etchable rods are subjected to being curved.
Figure 10B:
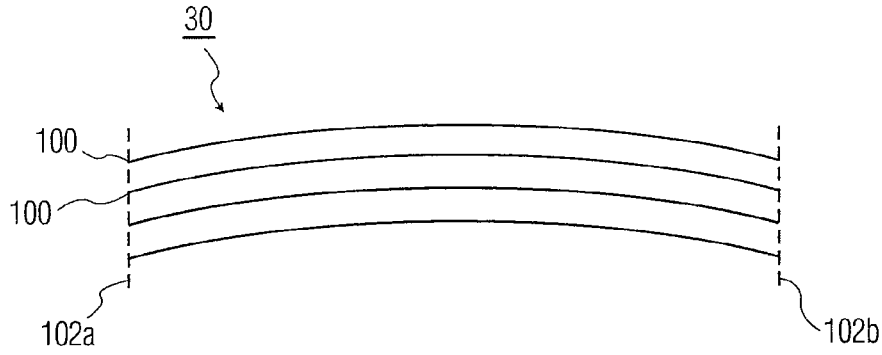
FIG. 10B is a partial cross-sectional view of the boule of FIG. 10A, after the microchannel etchable rods are subjected to being curved, in accordance with an embodiment of the present invention.

As shown in FIGS. 10A and 10B, the core rods, designated as 100 (clad glass not shown), do not stretch after bending. The square ends 102*a* and 102*b* of boule 30 remain parallel after bending. Since the core rods do not stretch, the diameters of the resulting microchannels (after dicing and etching) are not reduced in diameter. The present invention thus reduces light transmission through the MCP without producing visible shading or FPN due to bending (or curving).

Fundamental to this process is the difference in softening temperature between the two types of glass used in fabricating the boule. The core rod must have a higher softening temperature so that it resists stretching while the clad shears. As an analogy, a bundle of uncooked spaghetti may be bent, even though the individual pieces cannot be stretched. The bending of the uncooked spaghetti occurs as the individual pieces slide relative to each other.

It will be appreciated that the present invention attempts to reduce light transmission through the microchannels of an MCP. This may be achieved by preventing light from passing through the MCP without also reflecting off the walls of the microchannels. Furthermore, the bending (or curving) of the microchannels may be slight. For example, simply offsetting the centers of the microchannels by one channel diameter results in at least two reflections of light off the channel walls. The at least two reflections produce light attenuation, which is a desired goal. Thus, the amount of curvature of the microchannels may be quite small.

Inherent in the present invention is a variation in sliced MCP bias angle, since the slicing angle is usually fixed with respect to the boule. This angular variation may be reduced by slicing the MCP at 900 to the bending axis, but this adds bias direction variation.

Figure 9A:
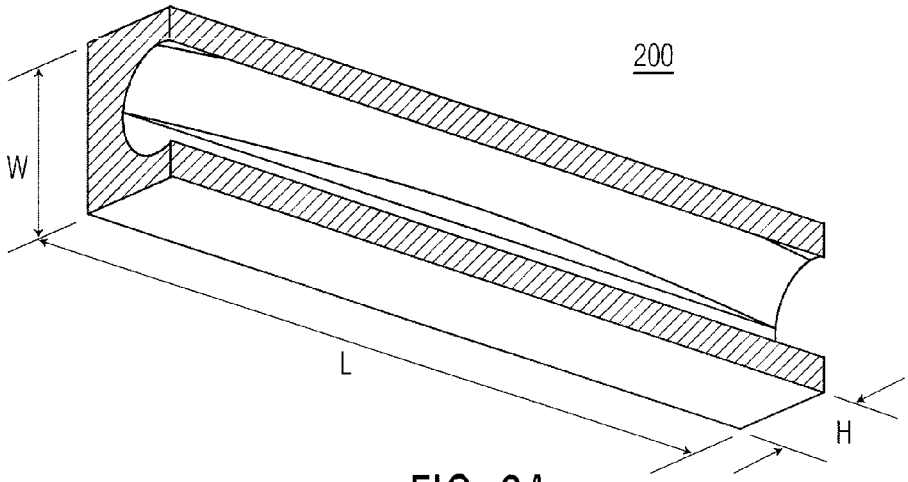
FIGS. 9A, 9B and 9C are different views of a mold used for providing a curvature to the boule shown in FIG. 5, in accordance with an embodiment of the present invention.
Figure 9B:
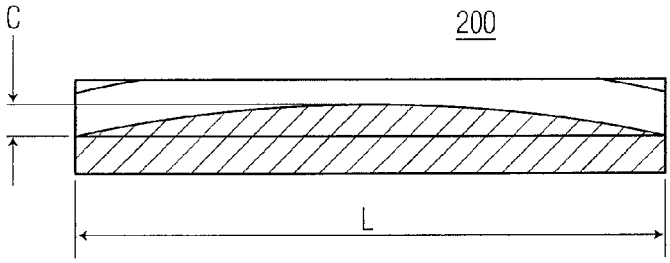
Figure 9C:
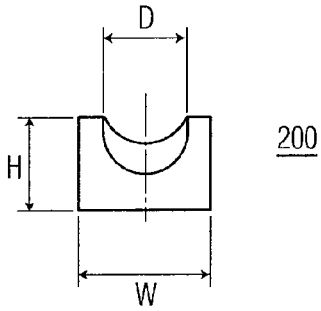

An exemplary structure for bending, or curving the boule is shown in FIGS. 9A, 9B and 9C. As shown mold 200 includes a structure having a longitudinal direction and a transverse direction. A notch is formed in the structure, extending in the longitudinal direction between ends of the structure. The notch forms a U-shape, oriented in the transverse direction. The U-shape has a portion of a first circle configured to receive and cradle a boule. The notch forms a portion of a second circle, oriented in the longitudinal direction and configured to impart a bend in the boule having a curved surface similar to the second circle.

The mold 200 is configured to receive the boule in a heated state having a first temperature effective in softening cladding glass in the boule, but having a temperature lower than a second temperature effective in softening core rods in the boule.

As an example of dimensions, mold 200 may have a length (L) of 8 inches, a height (H) of 1.25 inches, and a width (W) of 1.75 inches. The diameter of the notch (D) may be 1.125 inches and the curvature of the notch may form a minimum dimension C of 0.4 inches for a length (L) of 8 inches.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A boule for forming multiple MCPs comprising core rods formed of acid etchable glass, and cladding glass, surrounding the core rods, formed of acid resistant glass, wherein the core rods and the cladding glass extend longitudinally between ends of the boule, the core rods are smoothly curved between the ends of the boule, and the core rods have a lower softening temperature than the cladding glass.

2. The boule of claim 1 wherein the softening temperature of the core rods is at least 25 degree Centigrade lower than the softening temperature of the cladding glass.

3. The boule of claim 2 wherein the softening temperature of the core rods is approximately 550 degrees Centigrade and the softening temperature of the cladding glass is approximately 580 degrees Centigrade.

4. The boule of claim 1 wherein the core rods are substantially parallel to each other between the ends of the boule.

5. The boule of claim 1 wherein a core rod forms a portion of a circle intersecting a chord, and the chord is approximately 8 inches in length and the furthest distance from the chord to the circle is approximately 0.4 inches.

6. A mold for bending a boule for making multiple MCPs, the mold comprising a structure having a longitudinal direction and a transverse direction, a notch formed in the structure, extending in the longitudinal direction between ends of the structure, and a cylindrical boule including core rods formed of acid etchable glass, and cladding glass, surrounding the core rods, formed of acid resistant glass, wherein the core rods and the cladding glass extend longitudinally between ends of the boule, the notch forms a U-shape, oriented in the transverse direction, the U-shape comprised of a portion of a first circle configured to receive and cradle the boule, and the notch forms a portion of a second circle, oriented in the longitudinal direction, configured to impart a bend in the boule having a curved surface similar to the second circle.

7. The mold of claim 6 wherein the structure is configured to receive the boule in a heated state having a first temperature effective in softening cladding glass in the boule, and having a temperature lower than a second temperature effective in softening core rods in the boule.

8. A method for curving a boule having core rods and cladding glass surrounding the core rods, the method comprising the steps of:

placing the boule on a mold having a curved surface, heating the boule to a first temperature, wherein the first temperature is effective in softening the cladding glass, bending the boule after heating to the first temperature, so that the boule conforms to the curved surface, and in turn, bending the core rods.

9. The method of claim 8 including the step of:

dicing the boule to obtain multiple MCPs.

* * * * *